US007331636B2

(12) United States Patent
Troudt et al.

(10) Patent No.: US 7,331,636 B2
(45) Date of Patent: Feb. 19, 2008

(54) ELECTRIC MILLING MACHINE

(75) Inventors: Donald D Troudt, Marshall, WI (US); John Easton, Oconomowoc, WI (US); Robert A. Platek, Milwaukee, WI (US); Mark E. Vesely, Lisbon, WI (US); Michael A. Paulick, Kenosha, WI (US)

(73) Assignee: Prep Engineering, Inc., Pewaukee, WI (US)

( * ) Notice: Subject to any disclaimer, the term of this patent is extended or adjusted under 35 U.S.C. 154(b) by 0 days.

(21) Appl. No.: 10/960,438

(22) Filed: Oct. 7, 2004

(65) Prior Publication Data

US 2006/0076821 A1 Apr. 13, 2006

(51) Int. Cl.
*E01C 23/088* (2006.01)

(52) U.S. Cl. ..... 299/39.6; 299/39.4

(58) Field of Classification Search ..... 299/36.1, 299/39.1, 39.4, 39.6; 404/90, 93, 94; 180/209
See application file for complete search history.

(56) References Cited

U.S. PATENT DOCUMENTS

| | | | | |
|---|---|---|---|---|
| 4,966,418 | A * | 10/1990 | Wirtgen | 299/39.2 |
| 5,533,790 | A * | 7/1996 | Weiland | 299/1.5 |
| 5,641,206 | A * | 6/1997 | Craft | 299/37.1 |
| 6,106,073 | A * | 8/2000 | Simons et al. | 299/39.6 |
| 6,273,513 | B1 * | 8/2001 | Pope | 299/36.1 |
| 6,299,257 | B1 * | 10/2001 | Constantino | 299/36.1 |
| 6,513,881 | B2 * | 2/2003 | Pope | 299/36.1 |
| 6,540,305 | B2 * | 4/2003 | Phillips | 299/36.1 |
| 6,609,762 | B2 * | 8/2003 | Anderson | 299/37.2 |
| 6,705,798 | B2 * | 3/2004 | Dubay et al. | 404/84.05 |

FOREIGN PATENT DOCUMENTS

| | | | |
|---|---|---|---|
| EP | 1001088 | * | 5/2000 |
| EP | 1270817 | * | 1/2003 |
| EP | 1616996 A2 | * | 1/2006 |
| WO | WO 02/103117 | * | 12/2002 |

* cited by examiner

*Primary Examiner*—Sunil Singh
(74) *Attorney, Agent, or Firm*—Nicholas A. Kees; Godfrey & Kahn, S.C.

(57) ABSTRACT

A milling machine comprising a housing including a frame, a front wheel assembly supporting the housing, at least a first rear wheel assembly and a second rear wheel assembly supporting the housing, a milling drum mounted within the housing and extending below the housing, and an electric motor for providing power to at least one hydraulic system for operating milling machine functions. The first rear wheel assembly is ideally switchable between a first position and a second position to allow the milling machine to reach corners and other tight spaces in a building. The milling machine preferably further includes a dust collection system mounted within the housing to provide dust-free operation. The electric motor is also ideally mounted within the housing to provide a compact, dust-free and emissions-free milling machine for indoor use.

20 Claims, 8 Drawing Sheets

ELECTRIC MILLING MACHINE

BACKGROUND OF THE INVENTION

The present invention relates generally to the field of milling machines, and more particularly to an electric floor milling machine for indoor use.

Milling machines are commonly used to treat ground and floor surfaces, such as concrete, and to remove floor coverings, such as ceramic tiles and epoxy coatings. Because ground and floor surfaces are among the hardest construction materials, the milling machines powerful enough to treat or remove them must normally be very large and heavy. The power sources for such large and heavy machines are typically internal combustion engines, such as gasoline or diesel engines. Such machines work well for outdoor surfaces and surfaces in open areas, but are difficult, if not impossible, to use indoors. Very large machines will not fit inside many buildings, and the ventilation systems in many buildings are not equipped to deal with the exhaust produced by internal combustion engines. In the event that the machine will fit into the building, it can still be difficult to remove much of the floor surface because the machines cannot accomplish a milling function near walls or into corners and other tight spaces.

As a result, several attempts have been made to adapt conventional milling machines for indoor use, and to design new milling machines for indoor use. For example, U.S. Pat. No. 6,328,387 discloses an apparatus for removing floor coverings that is specifically designed to be sufficiently compact and narrow to be able to pass through doorways of residential buildings, comprising a rotary milling device in a housing supported by hydraulically powered elevating legs with wheels that is propelled by a separate energized vehicle. Further, U.S. Pat. No. 5,533,790 (the '790 Patent) discloses a milling machine for use inside buildings without releasing or emitting large amounts of dust into the surrounding environment, comprising a chassis structure supported by ground-engaging wheels, rotatable milling means, a vacuum system and a separate waste hopper. The '790 Patent further discloses the use of a petrol engine fueled by liquid petroleum gas to minimize pollution emissions.

Although some milling machines have been adapted or designed for use indoors, like those described above, those prior art milling machines still have significant limitations. Most significantly, the prior art milling machines do not provide a single, compact machine that effectively reduces both pollution and dust emissions. Additionally, it is still difficult if not impossible, using prior art milling machines, to reach corners and other tight spaces in the building.

Accordingly, a need exists for a single, compact indoor floor milling machine with improved pollution and dust emissions that can be used to remove flooring material in corners and other tight spaces. The present invention relates to improvements over the prior art as described above, and to solutions related to problems raised or not solved thereby.

SUMMARY OF THE INVENTION

The present invention provides a milling machine having a housing including a frame, a front wheel assembly supporting the housing, at least a first rear wheel assembly and a second rear wheel assembly supporting the housing, a milling drum mounted within the housing and extending below the housing, and an electric motor for providing rotational power to at least one hydraulic system for operating milling machine functions. At least the first rear wheel assembly is ideally switchable between a first position to provide stability and a second position to allow the milling machine to mill flooring surfaces near walls or other obstructions and in corners and other tight spaces. The milling drum is also ideally located in a rear corner of the milling machine adjacent the switchable first rear wheel assembly to further facilitate the ability to mill surfaces in corners and other tight spaces in buildings. The milling machine preferably further includes a dust collection system mounted substantially within the housing to provide dust-free operation. The electric motor is also ideally mounted within the housing to provide a compact, dust-free and emissions-free milling machine for indoor use.

The wheel assemblies are ideally independently driven providing an all-wheel drive system, and the rear wheel assemblies can ideally be independently raised and lowered to engage the milling drum with a flooring surface to be milled or treated. Further, the first position of the switchable first rear wheel assembly is preferably offset 180 degrees from the second position with respect to the orientation of a first rear wheel member of the first rear wheel assembly. The control of the first rear wheel member is also switchable so that it can ideally be driven in either direction, clockwise or counterclockwise, as necessary to rotate in concert with a front wheel member on the front wheel assembly and a second rear wheel member on the second rear wheel assembly whether the switchable first rear wheel assembly is in the first position or the second position. The switchable first rear wheel assembly allows the milling machine to reach floor surfaces near walls and other obstructions and in corners or other tight spaces in a building because when in the second position, the first rear wheel assembly is substantially flush with a side wall of the housing, and the milling drum is located in a rear corner of the milling machine adjacent the first rear wheel assembly.

The present invention further contemplates a method for milling corners in a building. The method includes the steps of (a) providing a milling machine having (i) a housing including a frame, (ii) a front wheel assembly supporting the housing, (iii) at least a first rear wheel assembly and a second rear wheel assembly supporting the housing, the first rear wheel assembly being switchable between a first position and a second position, the second position being substantially flush with a side wall of the housing, (iv) a milling drum mounted in a rear corner of the housing adjacent to the first rear wheel assembly and extending below the housing, and (v) an electric motor for providing power to at least one hydraulic system for operating milling machine functions, (b) rotating the first rear wheel assembly from the first position to the second position, and (c) reversing a rotational direction of a first rear wheel member of the first rear wheel assembly.

The present invention has many advantages over the prior art. First, the use of an electric motor not only reduces but eliminates the emissions associated with prior art internal combustion engines. The combination of the electric motor as the prime mover together with the hydraulic system provides an unsurpassed power to size ratio for the overall unit. The use of an on-board electric motor and dust collection system, moreover, allows for an emissions-free milling operation using a single, compact machine. Furthermore, the switchable first rear wheel assembly and the location of the milling drum in the rear corner adjacent the first rear wheel assembly of the present invention provides unexcelled stability while allowing the machine to easily maneuver into corners and other tight spaces, thereby allowing more of the flooring to be removed using the machine and reducing the amount of flooring that will need to be removed by other, more time-consuming means such as the use of a jackhammer. The use of an all-wheel drive system provides further advantages in that the milling machine of the present invention has positive traction, holds cutting positions better, and more easily climbs onto trailers for transport from one location to another.

Various other features, objects, and advantages of the present invention will be made apparent to those skilled in the art from the following detailed description and accompanying drawings.

DETAILED DESCRIPTION OF THE INVENTION

Figure 1:
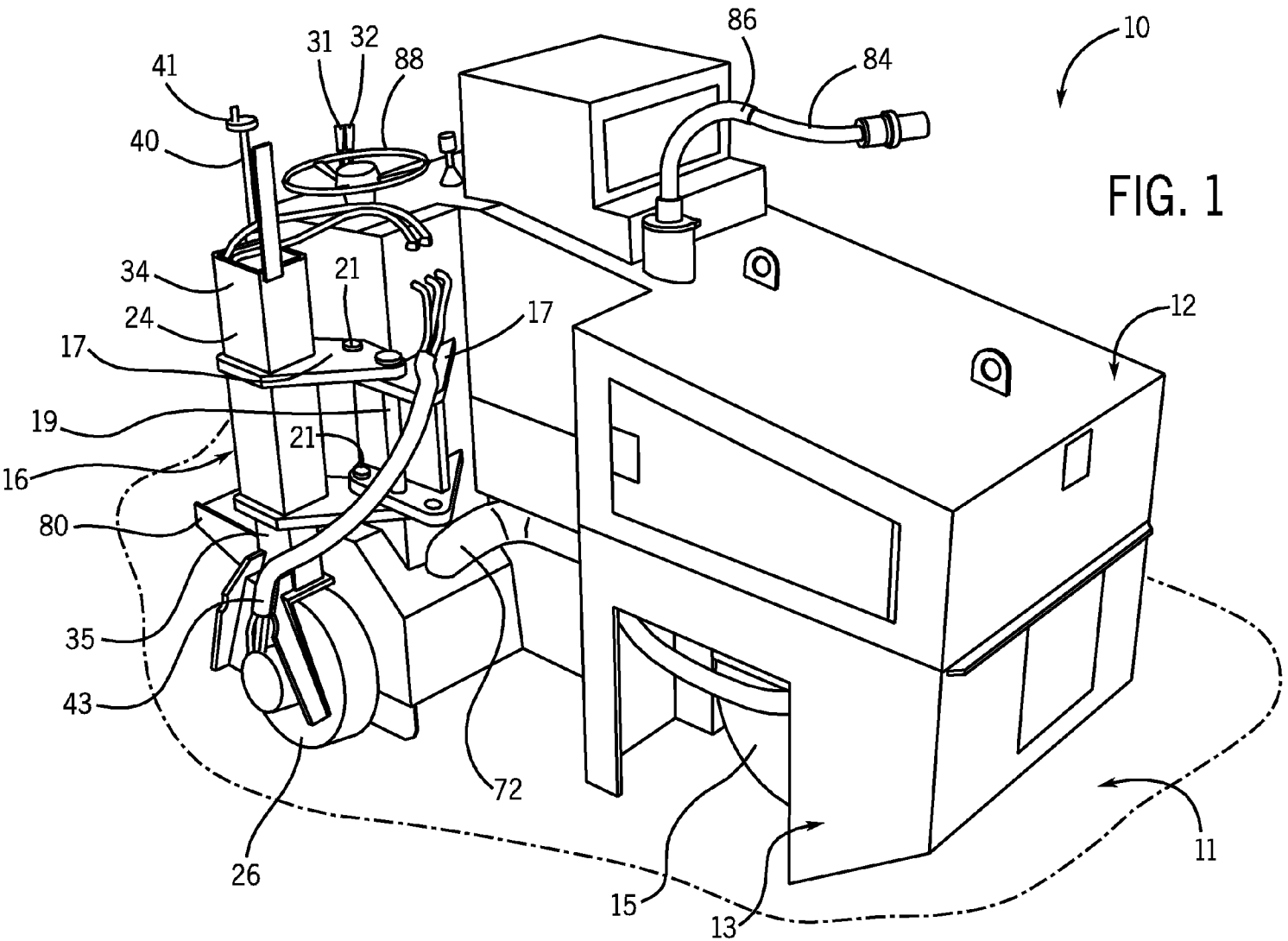
FIG. 1 is a perspective view of an embodiment of a milling machine constructed according to the present invention.

Referring now to the drawings, a milling machine 10 constructed according to one embodiment of the present invention includes a housing 12 including a frame 9. The housing 12 is supported by a front wheel assembly 14, a first rear wheel assembly 16, and a second rear wheel assembly 18. The housing 12 contains a milling drum 20 mounted within the housing 12 and extending below the housing 12 for engagement with the flooring surface 11, and an electric motor 22 that powers hydraulic systems for driving the milling drum 20, the first and second rear wheel assemblies 16, 18, and auxiliary systems such as a dust collection system. The housing 12 is ideally a compact housing that allows the milling machine to easily fit inside buildings. In the preferred embodiment, the housing 12 is under 7 feet tall, under 10 feet long, and under 6 feet wide; however, other sizes that allow the milling machine to easily be used indoors are also contemplated by the present invention.

The first and second rear wheel assemblies 16, 18, are used to engage the milling drum 20 with the flooring surface 11 to be removed, milled or otherwise treated, and to propel the milling machine 10 together with the front wheel assembly 14. Any suitable actuators to raise and lower the wheel assemblies may be used. As shown best in FIG. 3, the first rear wheel assembly 16 includes a first elevating column 24 coupled to a first rear wheel member 26. The first elevating column 24 operates to raise and lower the first rear wheel assembly 16 using a first hydraulic cylinder 27. In the embodiment shown, the first elevating column 24 has a first upper column member 34 and a first lower column member 35. The first lower column member 35 ideally has a smaller horizontal cross-sectional area than the first upper column member 34 and is preferably disposed inside the first upper column member 34 so that the first upper and lower column members 34, 35 can move vertically relative to one another similar to a telescoping mechanism. As the first elevating column 24 is lowered, the first lower column member 35 extends further inside the first upper column member 34. Accordingly, as the first elevating column 24 is raised, the first lower column member 35 extends further outside the first upper column member 34. The first hydraulic cylinder 27 is connected at one end to the first upper column member 34 and is connected at the other end to the first lower column member 35, which is connected to the first rear wheel member 26. A first control lever 31 (FIG. 1) is used by the milling machine operator to control the actuation of the first hydraulic cylinder 27 to raise and lower the first rear wheel assembly 16. Likewise, the second rear wheel assembly 18 includes a second elevating column 28 coupled to a second rear wheel member 30, and the second elevating column 28 operates to raise and lower the second rear wheel assembly 18 using a second hydraulic cylinder 29 connected at one end to a second upper column member 36 and at the other end to a second lower column member 37. A control lever 32 is used to control the actuation of the second hydraulic cylinder 29. Because the elevating columns 24, 28 can be operated independently, the milling machine can be used on flat surfaces or on sloped surfaces while maintaining a uniform depth of flooring surface removal or treatment. Raising and lowering the first and second rear wheel assemblies 16, 18 raises and lowers the housing 12, which in turn raises and lowers the milling drum 20 to engage and disengage the milling drum 20 from the flooring surface 11 to be removed or otherwise treated.

Figure 3:
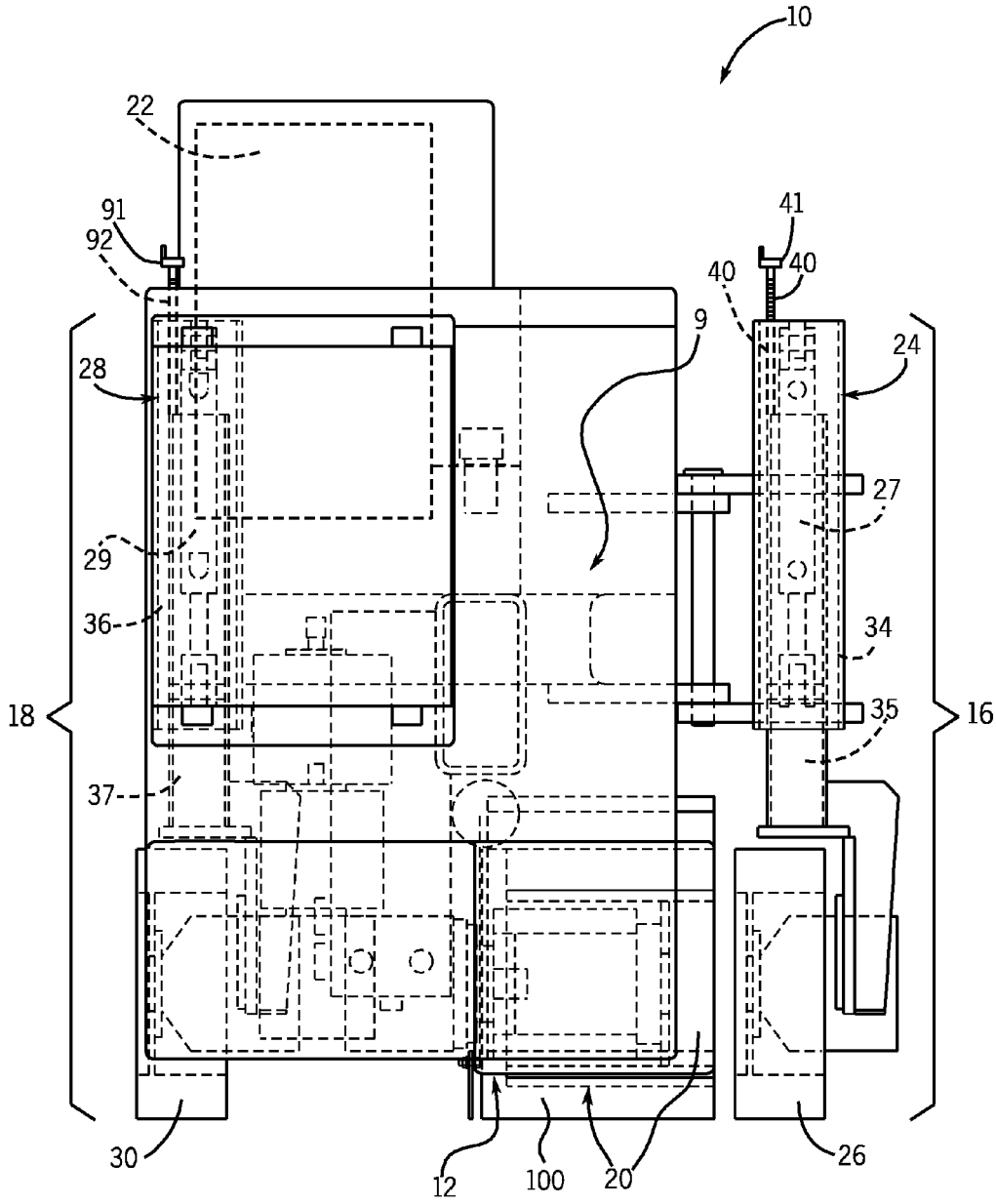
FIG. 3 is a rear elevation view of the milling machine of FIG. 1.

When a milling machine operator has lowered the first rear wheel assembly 16 to a desired location, a mechanical stopping device can be used to "lock" in the desired location as a lower limit. As shown best in FIG. 3, in the embodiment shown a first crank stop 40 is removably connected to the first upper column member 34, preferably using threads, so that one end of the first crank stop 40 extends into the inside of the first upper column member 34 and the other end of the crank stop extends above the first upper column member 34 and includes a first crank wheel 41. The first crank wheel 41 can be turned in one direction through the threaded connection to further extend the first crank stop 40 into the inside of the first upper column member 34, and in the other direction to retract the first crank stop 40 from the inside of first upper column member 34. To "lock in" a desired lower limit, the milling machine operator would first lower the first elevating column 24 to the desired location, and then turn the first crank wheel 41 to extend the first crank stop 40 into the first column member 34. The operator would turn the first crank wheel 41 until the other end of the crank stop 40 comes into contact with the first lower column member 35, which is disposed inside the first upper column member 34. The crank stop 40 will then prevent the milling machine operator from lowering the first elevating column 24 past that point because the crank stop 40 prevents the first lower column member 35 from extending any further inside the first upper column member 34. An analogous mechanical stopping device including a second crank stop 92 and a second crank wheel 91, also shown in FIG. 3, is ideally used in connection with the second elevating column 28.

Figure 4:
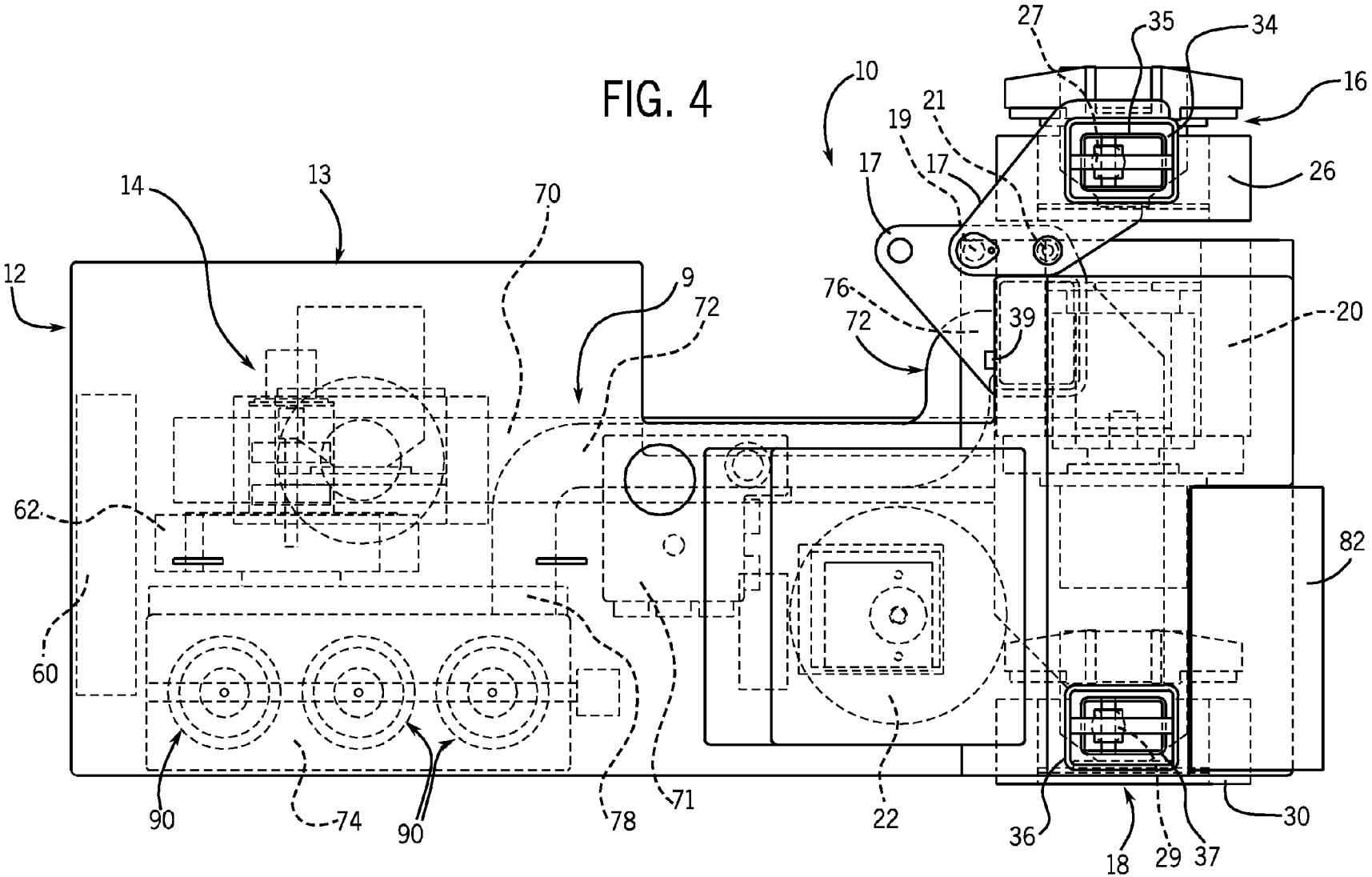
FIG. 4 is a top plan view of the milling machine of FIG. 1 showing the first rear wheel assembly in Position A.
Figure 5:
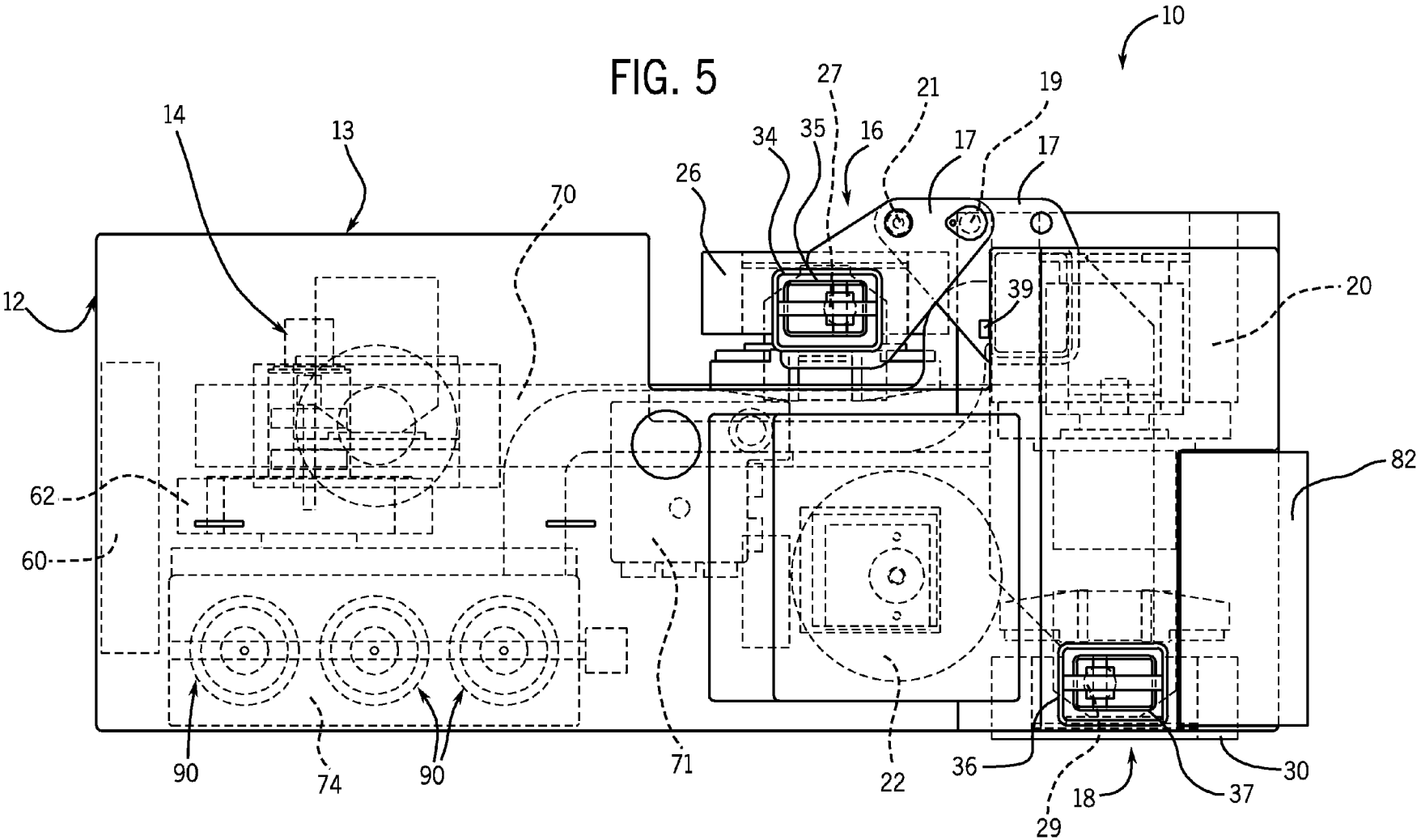
FIG. 5 is a top plan view of the milling machine of FIG. 1 showing the first rear wheel assembly in Position B.

In order for the milling machine to reach corners in a building, the milling drum 20 is positioned in the rear corner of the housing 12 adjacent the first rear wheel assembly 16, and the first rear wheel assembly 16 has the capability to operate in a first position and a second position, Position A and Position B. FIGS. 1-4 show the first rear wheel assembly 16 in Position A. FIG. 5 shows the first rear wheel assembly 16 in Position B. The first rear wheel assembly 16 is attached to the housing 12 by a hinge 17, and rotates about a hinge pin 19 of the hinge 17 when the first rear wheel assembly 16 is switched between Position A and Position B. As shown, when in Position B, the first rear wheel assembly 16 is substantially flush with a side wall 13 of the housing 12, and forward of the milling drum 20, allowing the milling drum in the rear corner of the housing 12 adjacent the first rear wheel assembly 16 to reach well into the inside corner of a building for floor treatment. In Position A, where the first rear wheel assembly 16 is alongside the milling drum 20, the wheel assembly would prevent the milling drum from reaching a width of flooring approximately equal to the width of the first rear wheel assembly. In Position B, however, the first rear wheel assembly 16 does not limit the flooring space that the milling drum 20 can reach. The flooring space that the milling drum 20 can reach is then only limited by the housing 12, and the position of the milling drum 20 within the housing. In the preferred embodiment, the milling drum 20 can ideally reach within about 4 inches of a wall or other obstacle when the first rear wheel assembly 16 is in Position B, as opposed to about 18 inches when the first rear wheel assembly 16 is in Position A.

With respect to the orientation of the first rear wheel member 26, Position B is offset 180 degrees from Position A. In the embodiment shown in the drawings, the first rear wheel assembly 16 is manually rotated and secured into either Position A or Position B using pins 21; however, other methods of rotating and securing the first rear wheel assembly 16 could also be used, such as a hydraulic cylinder or other powered actuator. A proximity switch 39 is ideally used to detect when the first rear wheel assembly 16 is in Position B. In that event, the hydraulic drive system for the first rear wheel assembly 16 has the ability to reverse the direction in which the first rear wheel member 26 rotates to propel the milling machine 10. Thus, for example, if the first rear wheel member 26 turns in a clockwise direction to propel the milling machine 10 in a forward direction when the first rear wheel assembly 16 is in Position A, the first rear wheel member 26 needs to turn in a counterclockwise direction to propel the milling machine 10 in a forward direction when the first rear wheel assembly 16 is in Position B. In order for the hydraulic drive system to reverse the direction in which the first rear wheel member 26 rotates, the hydraulic motor 44 (FIG. 6) that drives the first rear wheel member 26 is connected to the hydraulic drive system using flexible hoses 43 as shown in FIG. 1. Position A is ideally the default or normal operating position because it is best to have the two rear wheels, which in this case are the first and second rear wheel members 26, 30, aligned on a single axis. Position B is ideally mainly used when the milling machine 10 needs to reach near walls or other obstacles and in corners or other tight spaces.

In the preferred embodiment, electric motor 22 is a quiet, 480 volt, 3-phase, 50 horsepower electric motor that drives three main hydraulic systems that operate all the functions of milling machine 10. The type of electric motor, however, is not particular to the present invention, and thus any electric motor capable of supplying power to at least one hydraulic system for operating milling machine functions could be used in the present invention. In addition, the number of separate hydraulic systems is not particular to the present invention, and thus the present invention contemplates the use of any number of hydraulic systems, including at least one hydraulic system, powered by an electric motor.

The most preferred embodiment includes three hydraulic systems powered by the electric motor. A first hydraulic system, including a first hydraulic pump and a plurality of hydraulic motors, operates the wheel members 15, 26, 30 to propel the milling machine. A second hydraulic system including a second hydraulic pump and a plurality of hydraulic motors and cylinders operates the milling machine's auxiliary systems, such as the elevating columns 24, 28 and the dust collection system. A third hydraulic system having a third hydraulic pump and at least one hydraulic motor operates the milling drum 20.

Figure 6:
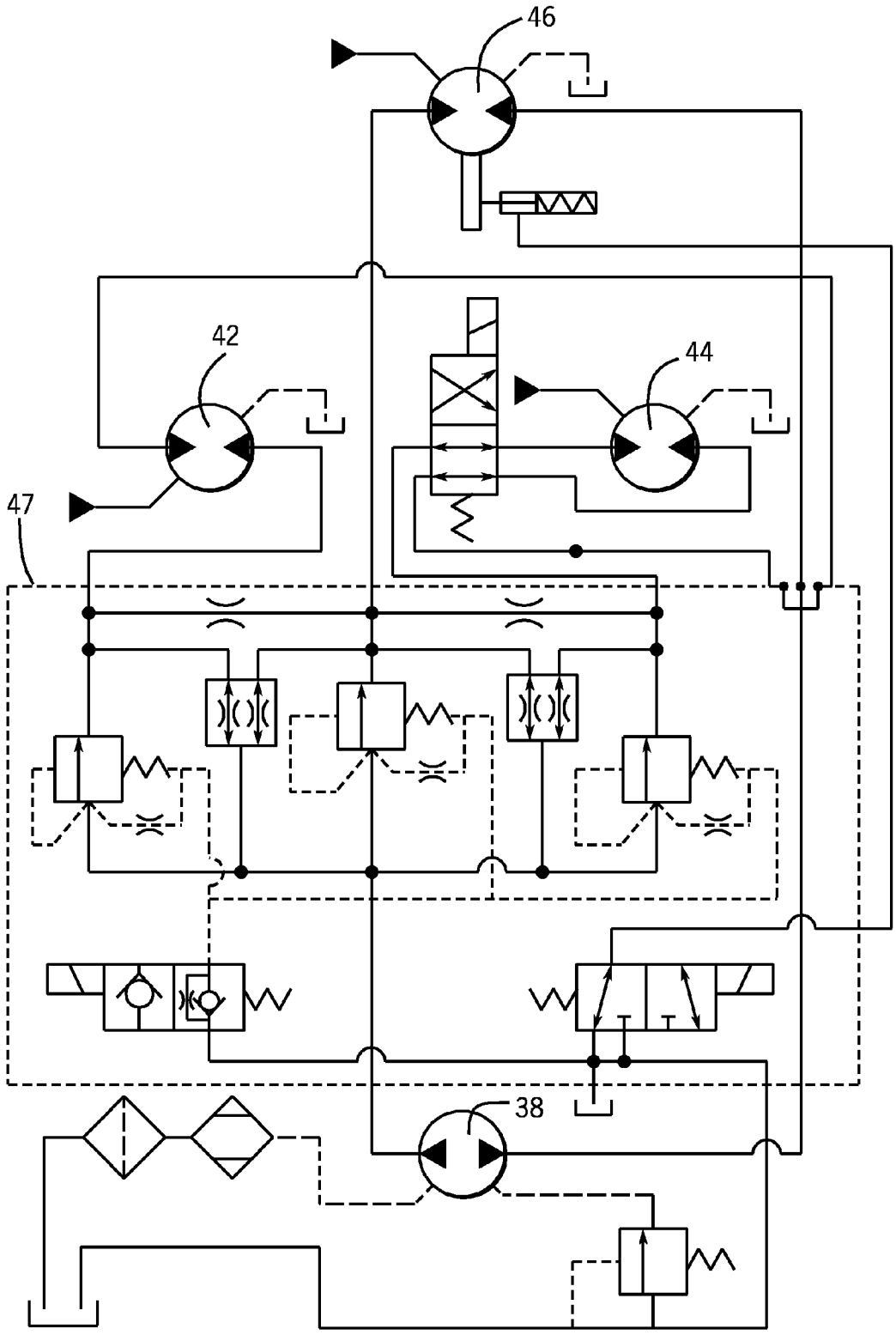
FIG. 6 is a hydraulics schematic illustrating one embodiment of a first hydraulic system for driving the wheel assemblies.

One embodiment of the first hydraulic system is shown in FIG. 6. In this embodiment each wheel member 15, 26, 30 has its own hydraulic motor, and thus the milling machine has an all-wheel drive system wherein each wheel member 15, 26, 30 is independently driven. As shown in FIG. 6, a bi-directional fixed displacement hydraulic pump 38 supplies pressurized hydraulic fluid to three motors, a first bi-directional motor 44 for driving the first rear wheel member 26, a second bi-directional motor 42 for driving the second rear wheel member 30, and a third bi-directional motor 46 for driving the front wheel member 15. The hydraulic system of FIG. 6 also includes a selectable positive traction system 47, for providing the option for a limited-slip all-wheel drive system. The positive traction system ensures that if one wheel member slips, or loses traction, the hydraulic motors for the remaining wheel members still receive an effective amount of hydraulic fluid to continue driving the remaining wheels. Without a positive traction system option, the hydraulic motor for the slipping wheel would always receive most of the hydraulic fluid because the path to that motor would be the one of least resistance. The positive traction system instead provides the option for substantially equalizing or balancing the amount of hydraulic fluid that travels to each wheel's motor. In the embodiment shown, a milling machine operator can manually select whether or not to operate the hydraulic drive system using equalized fluid flow. The option is ideal, but not necessary, because it is more efficient to operate the hydraulic drive system without equalized fluid flow. Thus, a milling machine operator can choose to operate without equalized fluid flow under normal operating conditions, and can then choose to operate with equalized fluid flow when a wheel is slipping. Of course, an operator could choose to operate with this equalized fluid flow at all times as well. The milling machine could also include an automatic selection feature that would detect, using sensors or other devices, when a wheel member loses traction and then automatically switch to operation with the balanced fluid flow feature.

Figure 7:
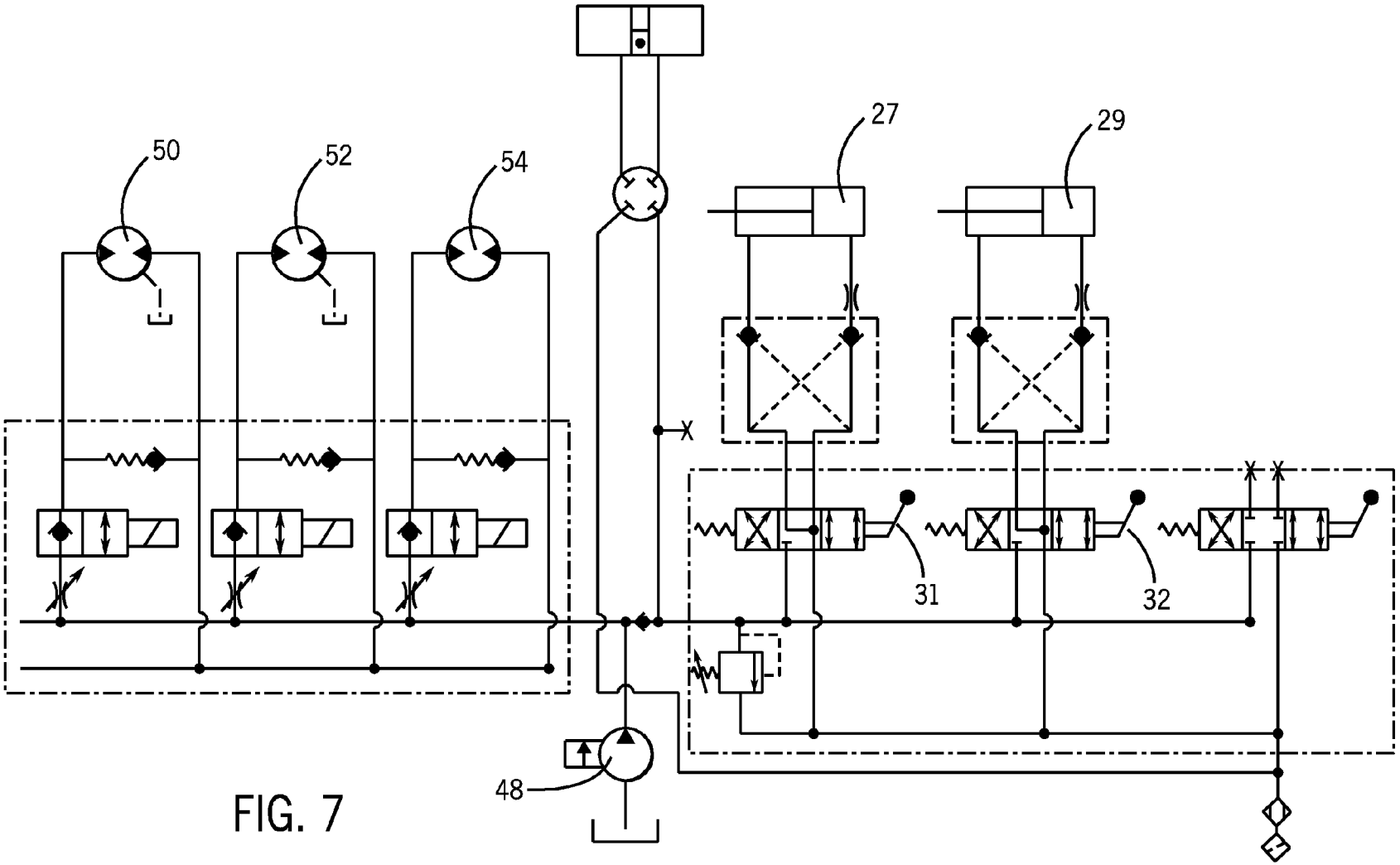
FIG. 7 is a hydraulics schematic illustrating one embodiment of a second hydraulic system for driving auxiliary systems.
Figure 8:
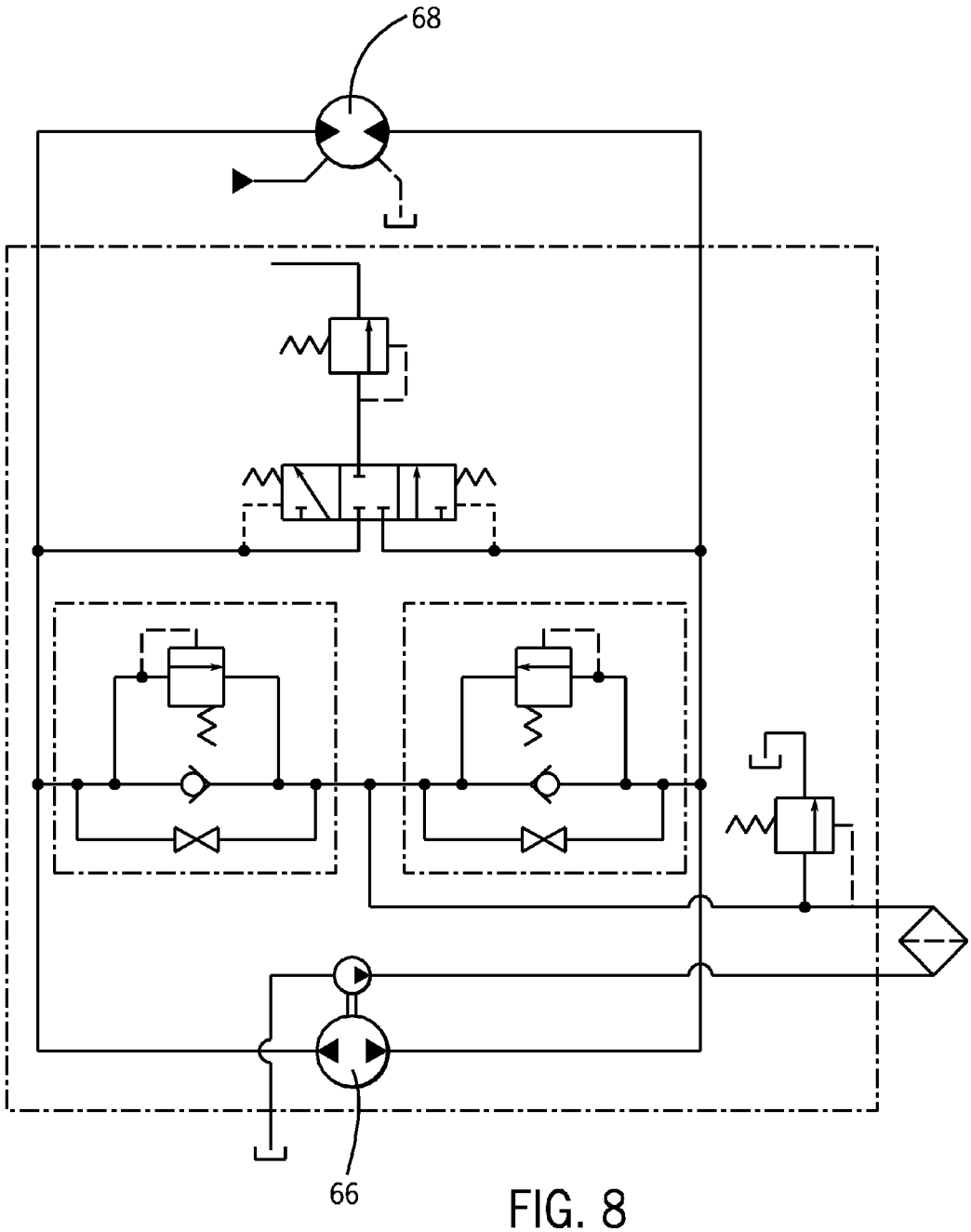
FIG. 8 is a hydraulics schematic illustrating one embodiment of a third hydraulic system for driving the milling drum.

One embodiment of the second hydraulic system is shown in FIG. 7 and one embodiment of the third hydraulic system is shown in FIG. 8. FIG. 7 shows a uni-directional hydraulic pump 48 that supplies pressurized hydraulic fluid to three hydraulic motors and the first and second hydraulic cylinders 27, 29. A first hydraulic motor 52 drives a blower 62 for the dust collection system. In the most preferred embodiment, a second hydraulic motor 54 may be provided to drive an air compressor (not shown) for use in cleaning the dust collector 74, and a third hydraulic motor 50 may be provided to drive a cooling fan 60 for the hydraulic systems. FIG. 8 shows a bi-directional pump 66 that supplies pressurized hydraulic fluid to a bi-directional motor 68 that drives the milling drum 20.

Fluid for the hydraulics systems is stored in at least one reservoir tank that is designed to fit within the milling machine housing and is ideally at least partially integrated with the frame 9. In the preferred embodiment, the reservoir tanks 70, 71 are shown most clearly in FIGS. 2 and 4. Reservoir tank 70 can also include a baffle (not shown) to facilitate proper circulation and cooling of the hydraulic oil. Although specific hydraulic system configurations are shown, other hydraulic system configurations are certainly possible and thus the configurations shown do not limit the present invention.

Figure 2:
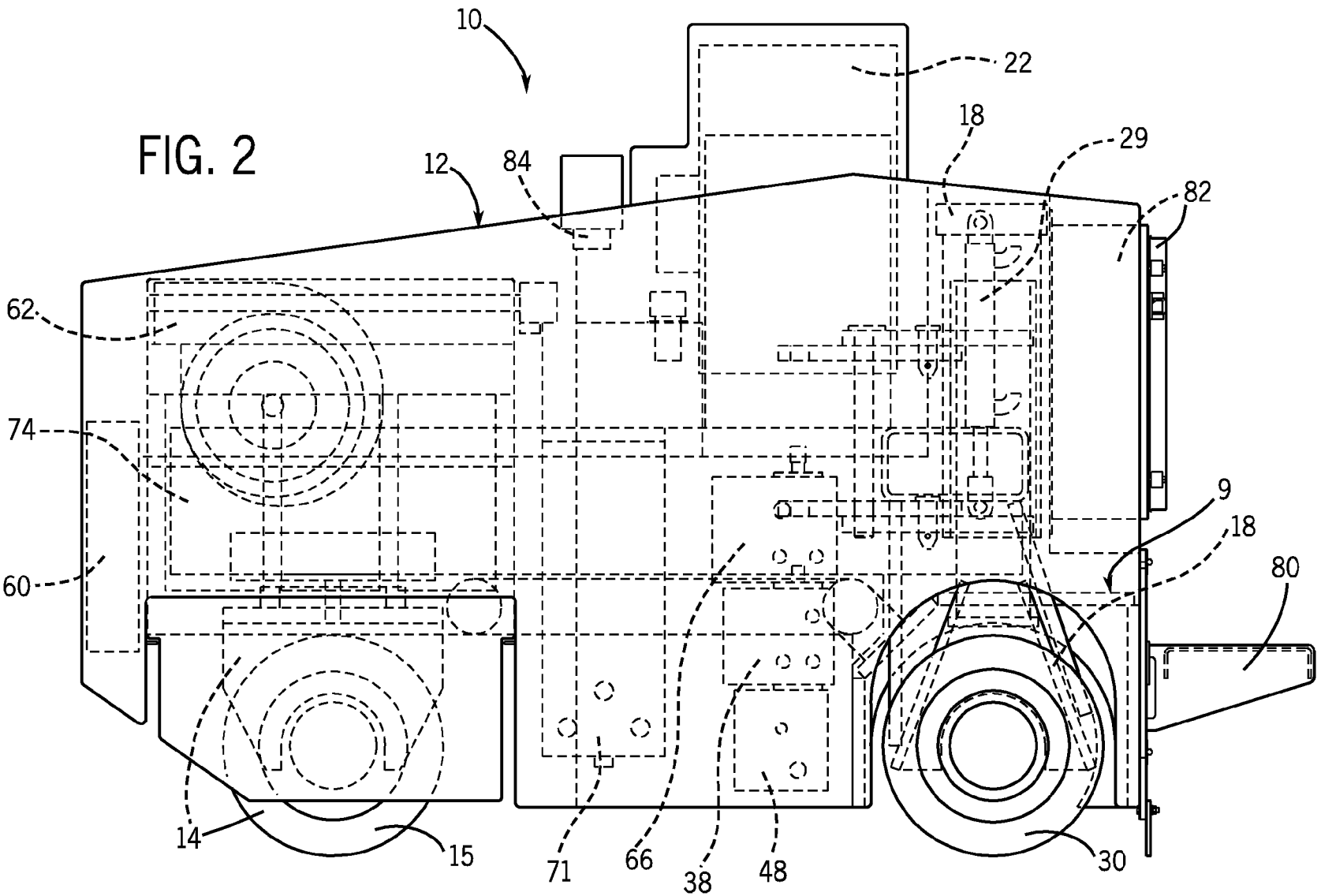
FIG. 2 is a side elevation view of the milling machine of FIG. 1.

The milling machine of the present invention also ideally includes an on-board dust collection system. As shown in FIGS. 2 and 4, the dust collection system provides a blower 62, intake duct 72, and dust collector 74. The blower 62 provides suction through the intake duct 72, which allows the intake duct 72 to pick up dust produced by the use of the milling drum 20 and to transport it to the dust collector 74. The intake duct 72 has a first end 76 positioned adjacent the front side of the milling drum 20 and a second end 78 connected to the dust collector 74. The dust collector 74 includes filters 90, and can also include a cleaner for periodically cleaning the filters, such as an air compressor (not shown) for providing compressed air to reverse pulse through the filters 90. The blower 72 and dust collector 74 are mounted completely within the milling machine housing 12, and the intake duct 72 is mounted substantially within the housing 12 to provide an on-board dust collection system. The intake duct 72 is partially exposed outside the housing 12 as it runs from the dust collector 74 to the front end of the milling drum 20, but is still connected within the housing at both the first end 76 and the second end 78 and thus is in no way a separate unit. A dust flap 100 can also be used to help control the dispersion of dust and other debris produced by the milling machine 10.

In operation, a milling machine operator stands on a platform 80, shown most clearly in FIGS. 1 and 2, located at the rear of the milling machine 10. A control box 82 is also mounted at the rear of the milling machine 10 and shown in FIGS. 2 and 4. A power cable 84 for supplying power to the electric motor 22 extends through a rotatable outlet pipe 86 and can be connected to a power source (not shown) in the building. The milling machine operator uses the first and second control levers 31, 32 to adjust the height of the rear wheel assemblies 16, 18 and, consequently, the height of the milling drum 20. The milling machine operator can ideally lock in a lower limit for the height of the rear wheel assemblies 16, 18 using mechanical stopping devices such as crank stops 40, 92 as described above. As also previously described, adjusting the height of the milling drum 20 adjusts the depth of flooring that will be removed or otherwise treated. Ideally, the milling drum 20 can remove up to a depth of 2 inches of flooring material with a single pass, with the most common milling depths being 0.5 inches to 1 inch, and the milling drum 20 is ideally up to 14 inches in width, though other milling depths and drum sizes are certainly possible. The milling drum 20 is further ideally capable of milling concrete, tile, epoxy and other hard floor coverings, and can ideally rotate at a maximum speed of 200 rpm, though other maximum speeds are of course possible and included in the scope of the present invention. In the preferred embodiment, the milling machine operator can steer the milling machine using steering wheel 88 that is ideally hydraulically coupled to the front wheel assembly 14, although other types of steering control, such as separate hydraulic control of the rear drive wheels, are also contemplated.

While the invention has been described with reference to preferred embodiments, it is to be understood that the invention is not intended to be limited to the specific embodiments set forth above. It is recognized that those skilled in the art will appreciate certain substitutions, alterations, modifications, and omissions may be made without parting from the spirit or intent of the invention. Accordingly, the foregoing description is meant to be exemplary only, the invention is to be taken as including all reasonable equivalents to the subject matter of the invention, and should not limit the scope of the invention.

What is claimed is:

1. A milling machine comprising:

a housing including a frame;

a front wheel assembly supporting the housing;

at least a first rear wheel assembly and a second rear wheel assembly supporting the housing, the first rear wheel assembly being switchable between a first position and a second position wherein the first position is offset 180 degrees from the second position with respect to the orientation of a first rear wheel member of the first rear wheel assembly;

a milling drum mounted within the housing and extending below the housing; and an electric motor for providing power to at least one hydraulic system for operating milling machine functions.

2. The milling machine of claim 1, further comprising a dust collection system mounted substantially within the housing.

3. The milling machine of claim 1, wherein each of the wheel assemblies is independently driven.

4. The milling machine of claim 1, wherein the first and second rear wheel assemblies can be independently raised and lowered.

5. The milling machine of claim 4, wherein raising and lowering the first and second rear wheel assemblies raises and lowers the milling drum.

6. The milling machine of claim 1, wherein the first rear wheel member can be driven in either a clockwise or counterclockwise direction as necessary to rotate in concert with a front wheel member of the front wheel assembly and a second rear wheel member of the second rear wheel assembly whether the first rear wheel assembly is in the first position or the second position.

7. The milling machine of claim 1, wherein one of the at least one hydraulic systems drives the wheel assemblies.

8. The milling machine of claim 1, wherein one of the at least one hydraulic systems operates the milling drum.

9. The milling machine of claim 1, wherein one of the at least one hydraulic systems operates auxiliary systems of the milling machine.

10. The milling machine of claim 1, wherein the front wheel assembly is coupled to a steering wheel for steering the milling machine.

11. The milling machine of claim 1, wherein the milling drum is located in a rear corner of the housing.

12. The milling machine of claim 11, wherein the rear corner is adjacent the first rear wheel assembly.

13. The milling machine of claim 1, wherein the electric motor is mounted within the housing.

14. The milling machine of claim 1, wherein the first rear wheel member is driven in a first rotational direction when the first rear wheel assembly is in the first position and a second rotational direction when the first rear wheel assembly is in the second position, the second rotational direction opposite the first rotational direction.

15. The milling machine of claim 14, wherein the first rear wheel member has a driven direction that is reversed when the first rear wheel assembly is in the second position.

16. A milling machine comprising:

a frame;

a housing including the frame;

a front wheel assembly supporting the housing;

a first rear wheel assembly and a second rear wheel assembly supporting the housing wherein the first rear wheel assembly is switchable between a first position and a second position, the second position offset from the first position by 180 degrees with respect to the orientation of a first rear wheel member of the first rear wheel assembly;

a milling drum mounted within the housing and extending below the housing;

an electric motor for powering at least a first hydraulic system for operating milling machine functions; and a dust collection system mounted substantially within the housing.

17. The milling machine of claim 16, wherein the electric motor is mounted within the housing.

18. The milling machine of claim 16, wherein a first hydraulic system operates the first and second rear wheel assemblies, a second hydraulic system operates the milling drum, and a third hydraulic system operates auxiliary systems on the milling machine.

19. The milling machine of claim 16, wherein the milling drum is located in a rear corner of the housing.

20. A milling machine comprising:

a housing including a frame;

a front wheel assembly supporting the housing;

at least a first rear wheel assembly and a second rear wheel assembly supporting the housing, the first rear wheel assembly being switchable between a first position and a second position wherein the first position is offset 180 degrees from the second position with respect to the orientation of a first rear wheel member of the first rear wheel assembly, and wherein the first rear wheel member is driven in a first rotational direction when the first rear wheel assembly is in the first position and a second rotational direction when the first rear wheel assembly is in the second position, the second rotational direction being opposite the first rotational direction;

a milling drum mounted within the housing and extending below the housing; and an electric motor for providing power to at least one hydraulic system for operating milling machine functions.

* * * * *